United States Patent [19]

Warn

[11] Patent Number: 4,860,383

[45] Date of Patent: Aug. 29, 1989

[54] DECORATIVE GARMENT

[76] Inventor: Storme G. Warn, 231 SW. 11th Ave., Hallandale, Fla. 33009

[21] Appl. No.: 202,302

[22] Filed: Jun. 6, 1988

[51] Int. Cl.[4] ..... A41D 3/08; A41D 15/00

[52] U.S. Cl. ..... 2/88

[58] Field of Search ..... 2/48, 49 R, 49 A, 50, 2/51, 52, 88, 89, 219, 220, 221

[56] References Cited

U.S. PATENT DOCUMENTS

| | | | |
|---|---|---|---|
| 254,440 | 2/1882 | Kurtz | 2/219 |
| 719,899 | 2/1903 | Stacey | 2/89 |
| 998,774 | 7/1911 | Howenstine | 2/221 |
| 1,068,351 | 7/1913 | Lynch | 2/221 |
| 1,091,294 | 3/1914 | Clark | 2/220 |
| 1,187,725 | 6/1916 | Goldsmith | 2/221 |
| 2,376,284 | 5/1945 | Sidelmann | 2/89 |
| 2,379,722 | 7/1945 | Kase | 2/50 |
| 2,637,853 | 5/1953 | Rochlin et al. | 2/50 X |
| 2,698,944 | 1/1955 | Ramsby | 2/50 X |
| 2,745,105 | 5/1956 | Schaefer | 2/89 |
| 2,799,022 | 7/1957 | Parise | 2/88 X |
| 2,854,670 | 10/1958 | Naccash | 2/221 |
| 4,038,697 | 8/1977 | Levitt | 2/49 A |
| 4,180,867 | 1/1980 | Ridgeway, Jr. | 2/89 |
| 4,466,137 | 8/1984 | Carnaghi | 2/221 X |
| 4,477,928 | 10/1984 | Graff | 2/221 |
| 4,688,271 | 8/1987 | Capelle | 2/220 |

FOREIGN PATENT DOCUMENTS

| | | | |
|---|---|---|---|
| 0026151 | 4/1981 | European Pat. Off. | 2/88 |
| 864223 | 4/1941 | France | 2/88 |
| 207139 | 9/1939 | Switzerland | 2/50 |
| 14024 | of 1904 | United Kingdom | 2/88 |
| 300885 | 11/1928 | United Kingdom | 2/88 |
| 302092 | 12/1928 | United Kingdom | 2/88 |

*Primary Examiner*—Werner H. Schroeder
*Assistant Examiner*—Jeanette E. Chapman
*Attorney, Agent, or Firm*—Malloy & Malloy

[57] ABSTRACT

A decorative garment comprising a sheet of fabric having a central opening therein sized for passage of the head, shoulders, or waist of a wearer. There is pocket structure about the cutout to accommodate a drawstring so that the size of the cutout may be varied. The garment is adapted to be draped over the body in a wide variety of fashions.

7 Claims, 1 Drawing Sheet

DECORATIVE GARMENT

FIELD OF THE INVENTION

This invention relates to a decorative garment which can be worn in a wide variety of styles.

BACKGROUND OF THE INVENTION

In the past, there have been numerous types of garments, such as ponchos, which are composed of a piece of fabric with an opening centrally arranged in it. Often such products are worn over the shoulders and are rectangular with a portion draping down over the front and rear of the wearer. This invention is of a somewhat similar structure; however, in its simplest form, it is composed of a decorative fabric, as opposed to a protective fabric, and, additionally, because of the versatility needed for the various styles in which the garment can be utilized, there is about the central opening, a pocket defining structure in which there is captivated a drawstring. Manipulation of the drawstring and, indeed, of the fabric itself of wnhich the garment is composed, provides for a wide variety of styles that can be achieved utilizing the garment. In an alternative embodiment, a cruciform sheet may be utilized which provides a further range of styles. It will be noted that there are no seams peripherally of the garment so that, preferably, it has a flowing draped characteristic which provides highly unusual and pleasing styles.

OBJECTS OF THE INVENTION

It is an object of this invention to provide a garment of the type described which is simple and inexpensive to manufactur, which is versatile and that a large number of styles may be achieved utilizing a single piece of fabric structured as set forth hereinafter.

In accordance with these and other objects, the instant invention will now be described on reference to the accompanying drawings in which:

DESCRIPTION OF THE PREFERRED EMBODIMENT

Figure 1:
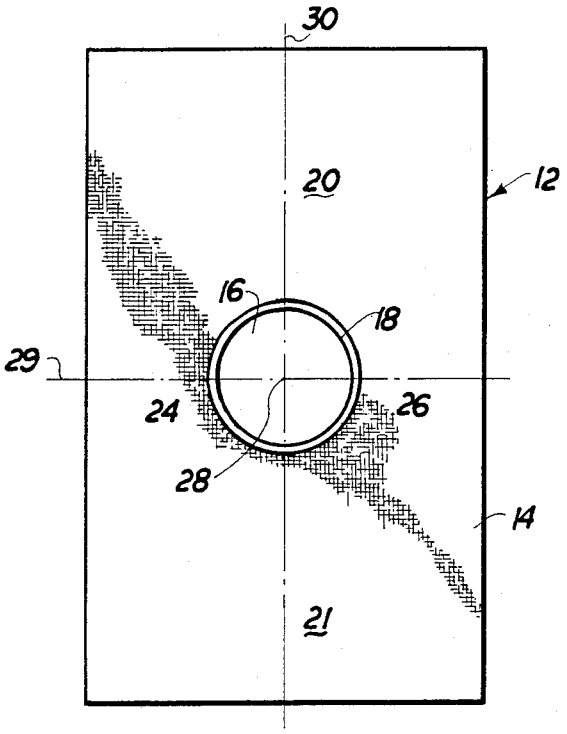
FIG. 1 is a plan view of the garment.

Generally, as shown in FIG. 1, the decorative garment is designated by the numeral 12 and is seen to be composed of a sheet of fabric 14 which is rectangular in shape and which has a cutout 16 in the central zone of it. The cutout is bounded by a pocket defining structure 18, see also FIG. 4. Within this pocket defining peripheral structure about the cutout, there is provided a drawstring 118 which may be, either, of elastic or nonelastic material. In the preferred embodiment, the drawstring is not of elastic material. Also, end portions of drawstring 118 extend outwardly from an opening in the pocket for manipulation thereof. Extending outwardly from the cutout there are two pairs of opposing wing zones or portions. In the embodiment shown in FIG. 1, these wing portions are designated by the numerals 20 and 21 in the case of the first pair and, in the case of the second pair, these are designated by the numerals 24 and 26. It is seen that the pairs of wing zones are perpendicular to one another. This is indicated by an imaginary line through the center 28 of the garment and the center of each pair of right angularly arranged wing portions. These imaginary centerlines are designated by the numerals 29 and 30 and define lines of symmetry. In other words, the decorative garment is symmetrical with respect to these centerlines through the wing portions.

In a preferred embodiment, the distance around the periphery of the central cutout is about 44 inches. This is so that the garment may be positioned over the head and/or shoulders of a user, or, indeed, about the waist of a user.

In use, the garment is capable of being worn in a wide variety of styles. For example, it mauy be worn if rolled upon itself into a string as a belt or sash. Additionally, it may be worn as a cape, an overskirt, or in various ways over the shoulders of a wearer. It can also be utilized as a halter and generaly has a wide variety of optional uses whereby a wearer can adapt it for the particular type of garment preferred. Also as set forth in greater detail in FIG. 5, the garment can be converted and/or used as a drape for other objects. The fabric is preferably highly decorative and may be of silk or hand-painted. It will be noted that there are no seams except at the center which provides a flowing garment capable of being draped or gathered into a wide variety of styles.

In the preferred embodiment, the overall longitudinal dimension of the garment is about 6 foot while the transverse dimension is between 3 and 5 feet.

Figure 2:
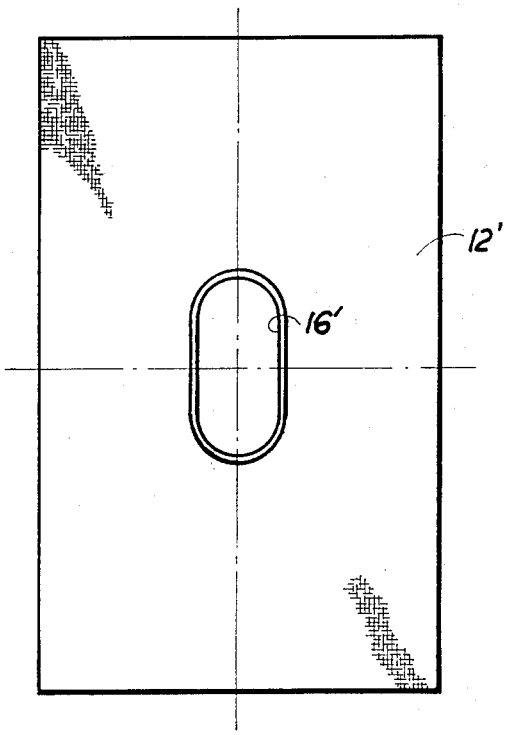
FIG. 2 is a plan view of an alternative embodiment of the garment.

Referring now to FIG. 2, there is shown a similar garment 12' which differs from that previously described only in that the central cutout 16' is oval.

Figure 3:
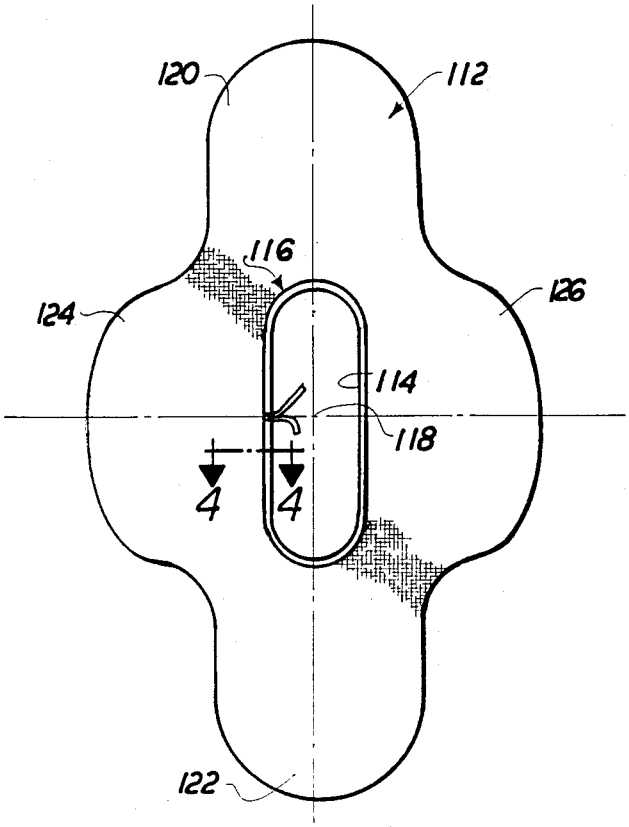
FIG. 3 is a third alternative embodiment of the decorative garment.

Referring to the embodiment shown in FIG. 3, the sheet is of cruciform and preferably has an oval central opening. In this embodiment, the sheet 112 is provided with the oval opening 114 which is bounded by the pocket structure 116 in which there is a drawstring 118. The first pair of wing portions is designated by the numerals 120 and 122 while the second pair of wing portions are designated by the numerals 124 and 126. It is seen, once again, that a centerline through the center of the cutout and through the wing portions defines a line of symmetry with respect to each of the pairs of wing portions.

Figure 4:
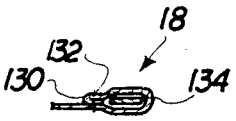
FIG. 4 is a view in cross-section taken on the plane indicated by the line 4—4 of FIG. 3 and looking in the direction of the arrows.

As shown in FIG. 4 the pocket structure 18 about the cutout may be composed of the edge 130. The cutout is folded back upon itself and stitched together as by the seam 132 so that the drawstring 134 may be captivated therein with the ends thereof extending outwardly through a suitable opening,not shown, for tightening the drawstring as also shown in FIG. 3.

Figure 5:
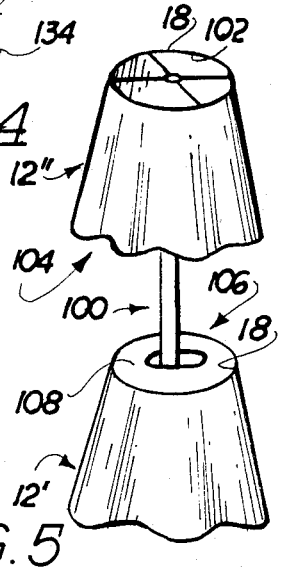
FIG. 5 is yet another alternate embodiment of the structure of the present invention being utilized as a drape for various objects.

FIG. 5 is directed to yet another embodiment of the present invention wherein the garment 12 is converted into a decorative drape positionable over various portions of a lampand/or lamp/table combination generally indicated as 100. In this embodiment, any of the structural configurations of the garment as appears in FIGS. 1, 2 or 3 can be utilized by draping such garment now generally indicated as 12'' over a lampshade structure 102 such that the central orifice 18 substantially surrounds and engages the preferred upper periphery of the shade structure 102 in the manner shown in FIG. 5. The remainder or the body portion including both wing zones can then hang, due to gravity, along the outer surface of the shade 102 and to a certain extent or length therebeyond as generally indicated as 104. Alternately, a table portion of the lamp structure 100 now being generally indicated as 106 could have its underportion covered by the convertible garment/drape 12'' wherein the cutout portion 18 surrounds a periphery of a horizontal platform or table surface 108 and extends downwardly therefrom in surrounding relation to any type of base used to support the planar table 108 on the floor or like supporting surface. It should be readily apparent therefore that the versatility of the garment 12', 12'', 112, and 12'' is increased due to the convertibility of the garment into a decorative drape for various objects or pieces of furniture as demonstrated in FIG. 5.

It is thus seen that there has been provided a simple, inexpensive, highly versatile decorative structure which can be worn as a garment in a wide variety of styles and which is either stored when not in use or used as a drape as demonstrated in the embodiment of FIG. 5.

While the instant invention has been shown and described in what is considered to be three practical and preferred embodiments, it is recognized that departures may be made within the spirit and scope of the claims which follow and this invention is therefore not to be limited except as set forth in the claims within the doctrine of equivalents.

What is claimed is:

1. A convertible decorative garment to be worn in a variety of styles and also structured for use as a decorative drape over a variety of objects, said garment comprising:

a sheet of an integral, one piece construction being formed of a seamless, flexible, drapable material comprising a central zone having a central cutout with the center of the cutout being coincident with the center of the sheet, said sheet having a first pair of wing zones and a second pair of wing zones, each pair extending from the central zone in generally perpendicular relation to one another, said wing zones of said first pair extending a greater distance from the central zone than said wing zones of said second pair, said sheet including an elongated pocket structure extending continuously about a periphery portion of said cutout, drawstring means movably mounted within said pocket for selectively varying the peripheral size of the cutout, said drawstring means being effective to be tightened or loosened to adjust the size of the cutout to a peripheral dimension of a portion of the object on which it is mounted, an aperture formed along the length of said pocket and disposed in communicating relation with an interior of said pocket, said drawstring means having an elongated configuration of sufficient length to extend along the entire length of said pocket and further including opposite free ends extending outwardly from the interior of the pocket through said aperture, and each pair of wing zones including an imaginary centerline, said imaginary centerlines intersecting one another through the center of said sheet and said cutout, said sheet being symmetrical about each of said centerlines of each pair of wing zones.

2. The garment as set forth in claim 1 wherein said sheet comprises a substantially rectangular configuration.

3. The garment as set forth in claim 1 wherein said sheet comprises a generally cruciform configuration.

4. The garment as set forth in claim 3 wherein said end zones of said first pair have outer edges and said outer edges merge and blend with the wing zones of the second pair.

5. The garment as set forth in claim 4 wherein said cutout comprises a substantially elongated, oval configuration.

6. The garment as set forth in claim 2 wherein said cutout comprises a substantially elongated, oval configuration.

7. The garment as in claim 1 wherein said drawstring means is formed of an elastic material.

* * * * *